US007104315B2

(12) United States Patent
Blomgren

(10) Patent No.: US 7,104,315 B2
(45) **Date of Patent: *Sep. 12, 2006**

(54) HEAT EXCHANGER PLATE, A PLATE PACK AND A PLATE HEAT EXCHANGER

(75) Inventor: Ralf Erik Blomgren, Skanör (SE)

(73) Assignee: Alfa Laval Corporate AB, Lund (SE)

( * ) Notice: Subject to any disclaimer, the term of this patent is extended or adjusted under 35 U.S.C. 154(b) by 0 days.

This patent is subject to a terminal disclaimer.

(21) Appl. No.: 10/495,894

(22) PCT Filed: Nov. 19, 2002

(86) PCT No.: PCT/SE02/02100

§ 371 (c)(1),
(2), (4) Date: May 17, 2004

(87) PCT Pub. No.: WO03/069249

PCT Pub. Date: Aug. 21, 2003

(65) Prior Publication Data

US 2005/0011638 A1 Jan. 20, 2005

(30) Foreign Application Priority Data

Dec. 18, 2001 (SE) ..... 0104282-9

(51) Int. Cl.
*F28F 3/04* (2006.01)

(52) U.S. Cl. ..... 165/165; 165/166; 165/DIG. 399

(58) Field of Classification Search ..... 165/165–167
See application file for complete search history.

(56) References Cited

U.S. PATENT DOCUMENTS

| | | | | |
|---|---|---|---|---|
| 3,568,765 | A | 3/1971 | Konrad | |
| 4,376,460 | A * | 3/1983 | Skoog | 165/167 |
| 4,378,837 | A | 4/1983 | Ospelt | |
| 4,664,183 | A * | 5/1987 | Fischer | 165/166 |
| 4,678,030 | A | 7/1987 | Almqvist | |
| 4,719,970 | A | 1/1988 | Fayolle | |
| 5,088,552 | A | 2/1992 | Raunio | |
| 5,226,474 | A | 7/1993 | Hallgren | |
| 5,443,115 | A * | 8/1995 | Pedersen et al. | 165/167 |
| 5,522,462 | A * | 6/1996 | Kumar et al. | 165/167 |
| 5,797,450 | A * | 8/1998 | Kawabe et al. | 165/167 |
| 6,073,687 | A * | 6/2000 | Jensen et al. | 165/167 |
| 6,318,456 | B1 * | 11/2001 | Brenner et al. | 165/167 |
| 6,802,365 | B1 * | 10/2004 | Huguet et al. | 165/166 |

FOREIGN PATENT DOCUMENTS

| | | |
|---|---|---|
| AT | 393162 | 8/1991 |
| EP | 165179 | 12/1985 |
| GB | 1 339 542 | 12/1973 |

* cited by examiner

*Primary Examiner*—Leonard R. Leo
(74) *Attorney, Agent, or Firm*—Fish & Richardson P.C.

(57) ABSTRACT

The invention refers to a heat exchanger plate (4) for a plate heat exchanger (1), a plate package (3) and a plate exchanger (1). The plate (4) includes at least a first area (31) with a corrugation of ridges and valleys, the plurality of which extends in a first direction (A), and at least a second area (32) with a corrugation of ridges and valleys, the plurality of which extends in a second direction (B). The plate (4) has a central rotary axis extending in parallel with a normal line of the plate. The areas (31, 32) have a respective contour coinciding with a respective imaginary contour in a first rotary position of the plate with regard to the rotary axis and after a rotation 90° to a second rotary position of the plate with regard to the rotary axis.

30 Claims, 4 Drawing Sheets

HEAT EXCHANGER PLATE, A PLATE PACK AND A PLATE HEAT EXCHANGER

THE BACKGROUND OF THE INVENTION AND PRIOR ART

The present invention refers to a heat exchanger plate for a plate heat exchanger, wherein the plate includes at least a first area with a corrugation of ridges and valleys, the plurality of which extends in a first direction, wherein the plate has a central rotary axis which extends in parallel with a normal line of the plate. The invention also refers to a plate package for a plate heat exchanger, and a plate heat exchanger.

Such heat exchanger plates for rotation a quarter of a round are known from EP-A-165 179. The plates have a substantially square shape and form a plate package where the inlets and the outlets extend through the sides of the plate package, i. e. the heat exchanger media flow into and out of the plate package in a direction which is substantially parallel to the main extension plane of the plates. Each plate has four side edges, wherein two opposite side edges are folded downwardly and the two other opposite side edges are folded upwardly. Every second plate is rotated 90° in the plate package, wherein the downwardly folded side edges of a plate abut the upwardly folded side edges of an adjacent plate, wherein these side edges are connected to each other by means of a weld joint. In each corner of each plate a tab is formed, which extends along a diagonal direction and in a plane that is substantially perpendicular to the extension plane of the plates.

The plates disclosed in EP-A-165 179 have an active heat exchanging surface with a corrugation of ridges and valleys, which extend in a diagonal direction that is inclined 45° to the side edges of the plates. Due to reasons of the manufacturing technology, a corrugation may not extend to the side edges but there has to be an edge area in order to enable, for instance, bending of the edge. The edge area may in principle be only a substantially line-shaped bending area but preferably the edge area has a substantially plane surface that has a width of 10–15 mm. By such a corrugation the plate becomes very rigid with regard to the shape in the diagonal direction, in which the ridges and the valleys extend, but is significantly less rigid transversely to the corrugation.

The plates are manufactured by compression moulding and when the plates are compressed for the shaping of the pattern, the material is extended transversally to the corrugation. When the press tool then is open and the plate is released, a certain backspring is obtained due to the elasticity of the material. Since the main backspring occurs in the direction in which the plate has the lowest shape rigidity the deformation becomes relatively large. The original square plate thus obtains after the compression moulding a rhombic shape. Such a rhombic shape leads to poor pattern fitting of the adjacent plates in the complete plate package, which in turn leads to lower pressure strength of the plate package.

SUMMARY OF THE INVENTION

The object of the present invention is to remedy the problems mentioned above. In particular, it is aimed at a plate, at a plate package with such a plate, and a plate heat exchanger with such a plate package, wherein the plate package is designed to maintain its outer shape after the compression moulding. The maintaining of the outer shape after the compression moulding. The maintaining of the outer shape after the compression moulding is important during the joining of the plates with modern welding methods such as laser beam welding.

This object is achieved by the plate initially defined, which is characterised in that the plate includes at least a second area with a corrugation of ridges and valleys, the plurality of which extends in a second direction, wherein these areas have a respective contour, which coincides with a respective imaginary stationary contour in a first rotary position of the plate with regard to said rotary axis and after a rotation of 90° to a second rotary position of the plate with regard to the rotary axis.

Since the heat exchanging surface includes two areas, which have a corrugation extending in a respective direction, the deformation of the shape in one of the areas may be counteracted by the deformation of the shape in the other area and vice versa. Consequently, the total deformation of the shape of the plate may be prevented or reduced and the original outer shape may substantially be maintained also after the compression moulding of the plate. The definition contour refers to the outer and inner contour of an area. One of said areas may for instance be completely enclosed in another of said areas, wherein the border of the latter outer area to the inner area forms the inner contour of the outer area.

According to an embodiment of the invention, the area of said first area is substantially equal to the area of said second area. Furthermore, the first direction is advantageously perpendicular to the second direction. By such a design of the plate, the deformation of the shape may be prevented substantially completely.

According to a further embodiment of the invention, the plate includes a diagonal line, wherein the first direction is substantially parallel to the diagonal line.

According to a further embodiment of the invention, the plate has a contour that coincides with an imaginary stationary contour in said first rotary position and in said second rotary position. Such a contour involves for instance a circular or a polygonal shape with at least four side edges, wherein the plate may have at least four corners and wherein said diagonal line extends between two opposite ones of said corners.

According to a further embodiment of the invention, the plate has an edge, which extends around the plate, and an edge area, which extends around the plate inside the edge. The total area of the edge area is relatively small in relation to the area of said first and second areas, which form an active heat exchanging surface. Furthermore, the plate may be substantially square and have four side edges, wherein two first of said side edges are parallel and folded in a first direction along a respective folding line extending in said edge area in parallel with the side edge in question, wherein two second of said side edges are parallel and folded in a second direction along a respective folding line extending in said edge area in parallel with the side edge in question, and wherein the first direction is opposite to the second direction.

According to a further embodiment of the invention, the plate includes a support area, which extends around said first and second areas inside the edge area and includes a corrugation of ridges and valleys. In such a corrugated support area, the ridges and valleys may be given a direction that is favourable for the specific position in which they will be located in the complete plate package so that the load is equalised between the different support points. By such a particular corrugation for the support area, the number of support points in this area in the proximity of the side edges of the plate may be substantially increased. At least a large number of the ridges and valleys in the support area may thus extend in a direction which deviates from the diagonal direction of the ridges and valleys of the heat exchanging surface. The ridges and the valleys of the support area will be shorter in their extension direction in comparison with the ridges and valleys of the heat exchanging surface. Advantageously, the plate includes a marked border line between the heat exchanging surface and the support area.

According to an embodiment of the invention, the support area has in each corner such a ridge or valley, which extends in a direction that substantially coincides with a diagonal line between the corners. Furthermore, substantially each ridge and valley of the support area along a central part of the side edges may extend in a direction which is substantially perpendicular to the side edge lying most closely to said ridge and valley. By such a design of the support area the number of support points in this area may be iincreased with up to 50%. The ridges and the valleys in the support area may also have substantially the same spacing as the ridges and valleys of the heat exchanging surface. Advantageously, the direction of the ridges and the valleys of the support area changes successively from the substantially diagonal direction in the corners to the substantially perpendicular direction in the central parts.

According to a further embodiment of the invention, the plate includes an extension plane, which extends in and in parallel to the edge area, wherein said valleys of the first and second areas are located at the extension plane and said ridges of the first and second areas are located above the extension plane. Said valleys of the support area may advantageously be located below the extension plane and said ridges of the support area above the extension plane.

The object is also achieved by a plate package for a plate heat exchanger, which includes a number of plates arranged on each other as defined above. The plates in the plate package may advantageously be arranged in such a way that every second plate is rotated 90° around said rotary axis and in such a way that interspaces are formed between adjacent plates, wherein said first and second areas have such a shape that the contour of the first area coincides for all plates in the plate package and that the contour of the second area coincides for all plates in the plate package. Furthermore, the plates in the plate package may be welded to each other, wherein the plates are arranged on each other in such a way, that said first side edges of a plate abut said second side edges of an adjacent plate, and wherein these side edges are connected to each other by means of a weld joint. Substantially all plates in the plate package may be substantially identical. Furthermore, said interspaces may include a number of first interspaces and a number of second interspaces, wherein the first interspaces are arranged to convey a first medium through the plate package and the second interspaces are arranged to convey a second medium through the plate package.

The object is also achieved by a plate heat exchanger including a plate as defined above.

The object is also achieved by a plate heat exchanger including a plate package as defined above.

BRIEF DESCRIPTION OF THE DRAWINGS

The present invention is now to be explained more closely by a description of various embodiments disclosed by way of example and with reference to the drawings attached hereto.

DETAILED DESCRIPTION OF VARIOUS EMBODIMENTS OF THE INVENTION

Figure 1:
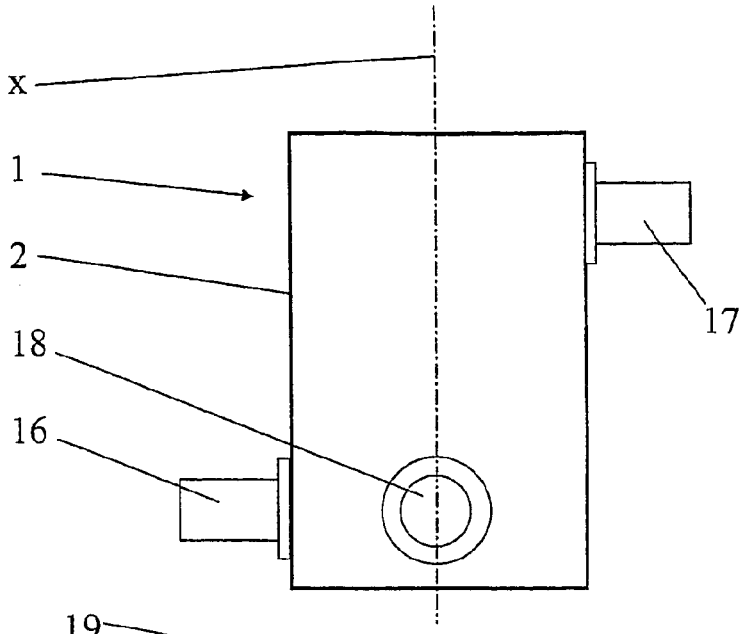
FIG. 1 discloses a side view of a plate heat exchanger.
Figure 2:
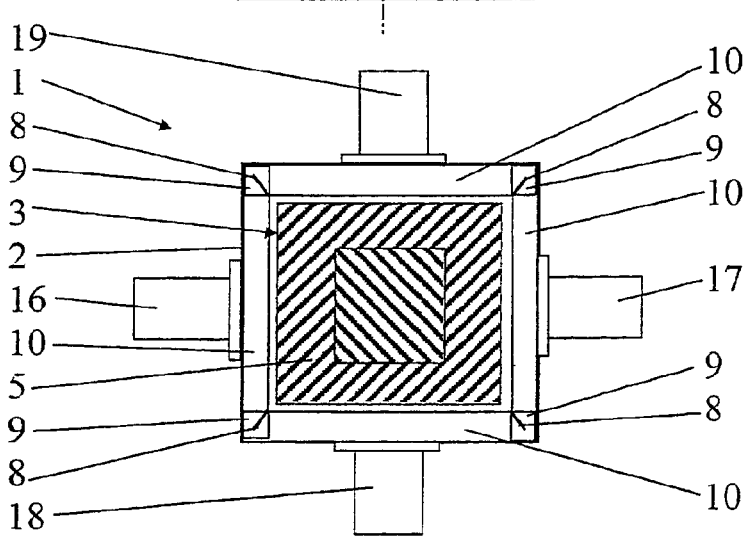
FIG. 2 discloses a sectional view along the line II—II in FIG. 1.
Figure 3:
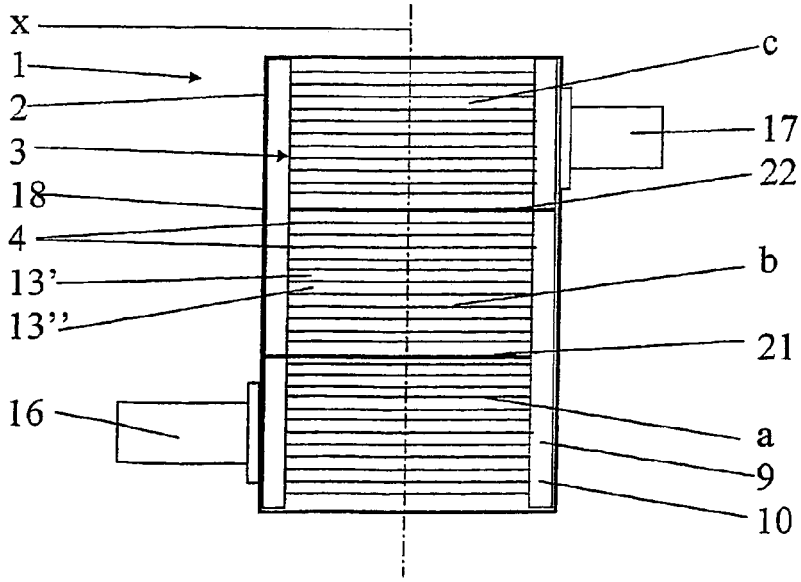
FIG. 3 discloses a sectional view along the line III—III in FIG. 2.

FIGS. 1–3 disclose a plate heat exchanger 1. The plate heat exchanger 1 includes an outer casing 2 and a plate package 3, which is arranged inside the casing 2. The plate package 3 includes a number of heat exchanger plates 4 which are stacked on and attached to each other.

The plates 4 have a central rotary axis x, which extends in parallel with a normal line of a main extension plane p of each plate 4. All plates 4 are substantially identical and have in the embodiment disclosed a substantially square shape with four corners. It is to be noted that the plates 4 also may have another polygonal or circular shape. The plates 4 are rotatable around the axis x in such a way that the outer contour of the plates 4 coincides with an imaginary stationary contour in a first rotary positioned and after rotation 90° to a second rotary position.

Figure 4:
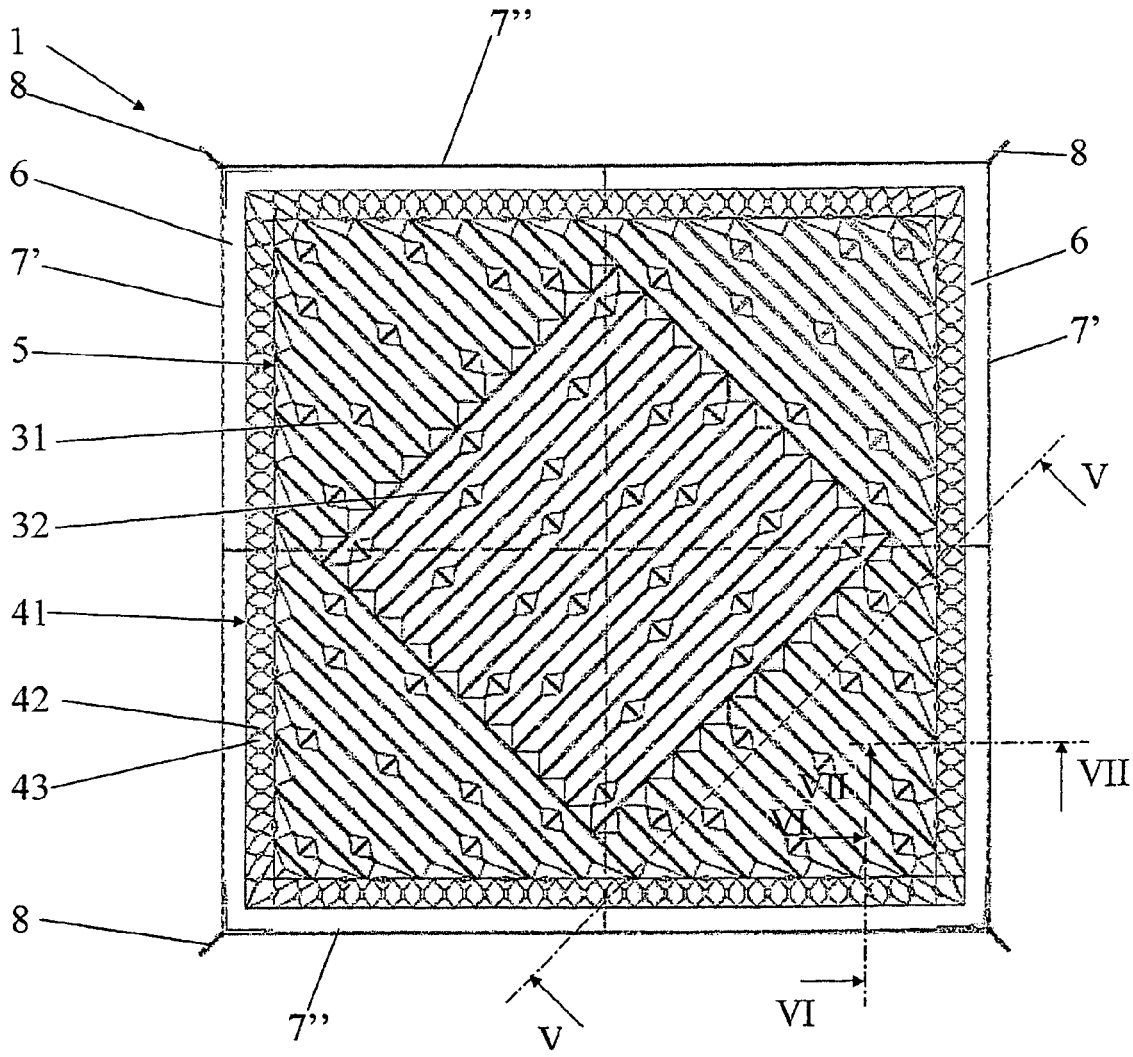
FIG. 4 discloses a plan view of a plate package of the plate heat exchanger.
Figure 5:
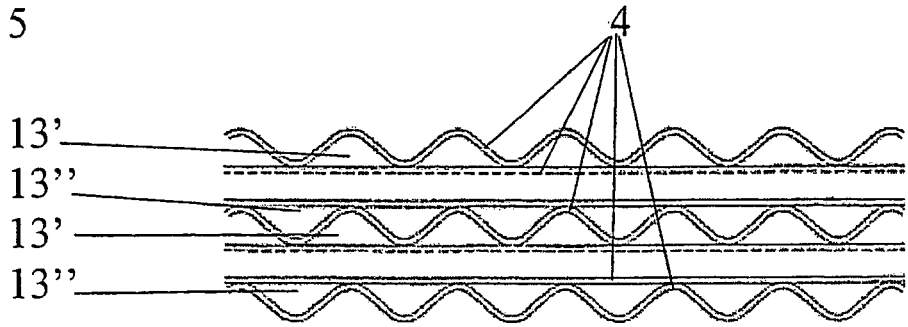
FIG. 5 discloses a sectional view along the line V—V in FIG. 4.

Each plate 4 has a heat exchanging surface 5 with a corrugation of ridges and valleys, see FIG. 4. Each plate 4 also has an edge, which extends round the plate 4, and a substantially line-shaped or surface-shaped edge area 6, which extends around the heat exchanging surface 5 inside the edge. In the embodiment disclosed, the edge forms four side edges 7', 7". Two 7' of the side edges are parallel to each other and folded downwardly in a first direction along a respective folding line that extends in the edge area 6 in parallel with the side edge 7' in question. The two second 7" side edges are also parallel to each other and folded upwardly in a second opposite direction along a respective folding line extending in the edge area 6 in parallel with the side edge 7" in question. In each corner of each plate 4 a tab 8 is formed when folding the side edges, which extends along a diagonal direction and in a plane which is substantially perpendicular to the extension plane p of the plates 4. These tabs 8 function as attachment members for mounting the plates 4 and the plate package 3 in the casing 2. More specifically, the tabs 8 are directly or indirectly attached in longitudinal groves in four corner posts 9 which are arranged in a respective corner in the inner space of the casing 2. The corner posts 9 also function to delimit four part spaces 10 between the casing 2 and the plate package 3.

Every second plate 4 in the plate package 3 is rotated 90° around the rotary axis x, wherein the plates 4 are arranged in the plate package 3 in such a way that interspaces 13', 13" are formed between adjacent plates 4 and that the first side edges 7' of a plate 4 abut the second side edges 7" of an adjacent plate 4. The adjacent side edges 7' and 7" are attached to each other by means of a weld joint 14, see FIG. 7. The weld joint 14 may be obtained by means of laser beam welding or electron beam welding. The interspaces 13', 13" include a number of first interspaces 13' and a number of second interspaces 13", see FIGS. 4–7. In such a way, the plate package 3, seen from two opposite sides, will be open with regard to the first interspaces 13' and closed with regard to the second interspaces 13". Seen from the two other opposite sides, the plate package 3 will be closed with regard to the first interspaces 13' and opened with regard to the second interspaces 13". The first interspaces 13' are arranged to convey a first medium through the plate package 3 and second interspaces 13" are arranged to convey a second medium through the plate package 3.

The plate heat exchanger 1 includes a first inlet 16 and a first outlet 17 for the first medium, and a second inlet 18 and a second outlet 19 for the second medium. The inlets and the outlets to the plate package 3 proper extend though the sides of the plate package 3, i. e. the heat exchanger media flow into and out of the plate package 3 in a direction that is substantially parallel to the main extension plane p of the plates 4. In the embodiment disclosed, the plate package 3 includes three part packages a, b, c. The part packages a, b, c are delimited from each other by means of two delimiting plates 21, 22. It is to be noted that the plate package 3 may include another number of part packages, for instance 1, 2, 4 or more such part packages.

In the embodiment disclosed, the first medium is conveyed in through the first inlet 16 into the part package a through one side to the first interspaces 13'. The first medium leaves the part package a through the opposite side and is conveyed into the part space 10. In the part space 10, the first media is conveyed passing the delimiting plate 21 and into the part package b through a side to the first interspaces 13'. The media leaves the part package b through the opposite side and enters the opposite part space 10. In this part space 10 the first media is conveyed passing the second delimiting plate 22 and into the part package c through the side to the first interspaces 13'. Thereafter, the first media leaves to plate heat exchanger 1 via the opposite side of the part package c, the part space 10 and the second outlet 17. In a corresponding manner the second media is conveyed into the first inlet 18 through the plate heat exchanger 1 and via the second inlet 19. It is to be noted that the second media also may be conveyed in counterflow to the first media in such a way that the outlet 19 forms an inlet and the inlet 18 an outlet.

The heat exchanging surface 5 includes in the embodiment disclosed in FIG. 4 a first area 31 with a corrugation of ridges and valleys, and a second area 31 with a corrugation of ridges and valleys. The valleys of both the areas 31, 32 of the heat exchanging surface 5 are located at or at the level of the extension plane p and the ridges of both the areas 31, 32 of the heat exchanging surface 5 are located above the extension plane p.

The ridges and the valleys in the first area 31 extend in a first direction A, and the ridges and the valleys in the second area extend in a second direction B. The first direction A is substantially perpendicular to the second direction B. Furthermore, the first direction A is substantially parallel to a diagonal line extending between two opposite corners of the plate 4, and the second direction B is parallel to a diagonal line extending between the other two opposite corners of the plate 4. It is to be noted that the ridges and the valleys of the areas 31, 32 of the heat exchanging surface 5 may extend along other directions than those disclosed. The ridges and valleys in the first area 31 do not need to extend perpendicularly to the ridges and valleys in the second area 32 but it is important that the ridges and valleys in the first area 31 form an angle to the ridges and valleys in the second area 32. The ridges and valleys of the areas 31, 32 of the heat exchanging surface 5 may also extend along curved path and have larger or smaller interruptions or irregularities, for instance in order to form support points in relation to adjacent surfaces or in order to influence the flow through the plate heat exchanger 1. Inserted portions with deviating patterns may also be present for other reasons.

The area of the first area 31 is substantially equal to the area of the second area 32. Each of the areas 31, 32 also has an outer and/or inner contour which coincides with a respective imaginary stationary contour in the first rotary position of the plate 4 with regard to the rotary axis x and after a rotation of 90° to the second rotary position of the plate 4 with regard to the rotary axis x. The second inner area 32 is square and rotated 45° in relation to the first outer area 31, which also is square. The outer contour of the inner area 32 forms or coincides with the inner contour of the outer area 31. In the plate package 4 a ridge of the heat exchanging surface 5 will substantially always abut a valley of the heat exchanging surface 5 of an adjacent plate 4, wherein this ridge crosses this valley in such a way that a support point or a small support area is formed.

Each plate 4 includes a support area 41, which extends around the heat exchanging surface 5 inside the edge area 6. The support area 41 also includes a corrugation of ridges 42 and valleys 43. The border between the support area 41 and the heat exchanging surface 5 is marked with a border line 44 that is located at or at the level of the extension plane p. The valleys 43 of the support area 41 are located below the extension plane p and the ridges 42 of the support area 41 are located above the extension plane p.

In the proximity of each corner, the support area 41 has such a ridge 42 or valley 43 extending in a direction that substantially coincide with a diagonal line between the corners. Along a central part of the side edges, substantially each ridge 42 and valley 43 of the support area 41 extends inside one of the side edges in a direction which is substantially perpendicular to the side edge which lies most closely to said ridge 42 and valley 43. The direction of the ridges 42 and the valleys 43 of the support area 41 changes successively from the diagonal direction in the corners to the perpendicular direction in the central parts.

Figure 6:
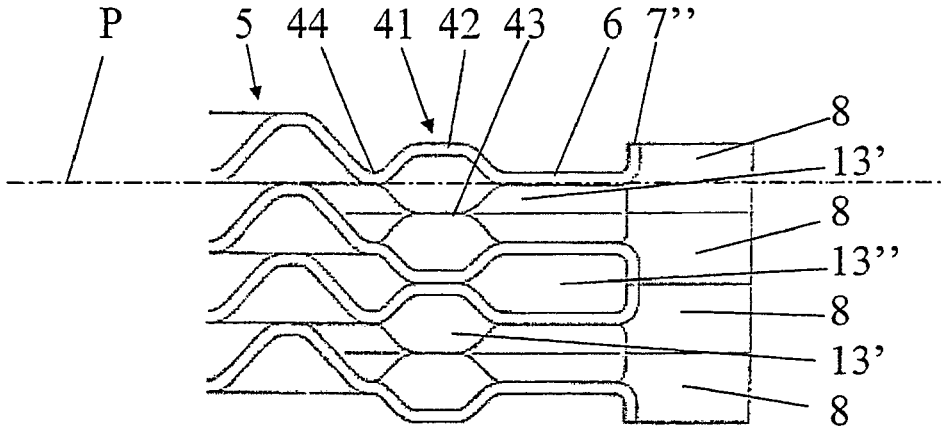
FIG. 6 discloses a sectional view along the line VI—VI in FIG. 4.
Figure 7:
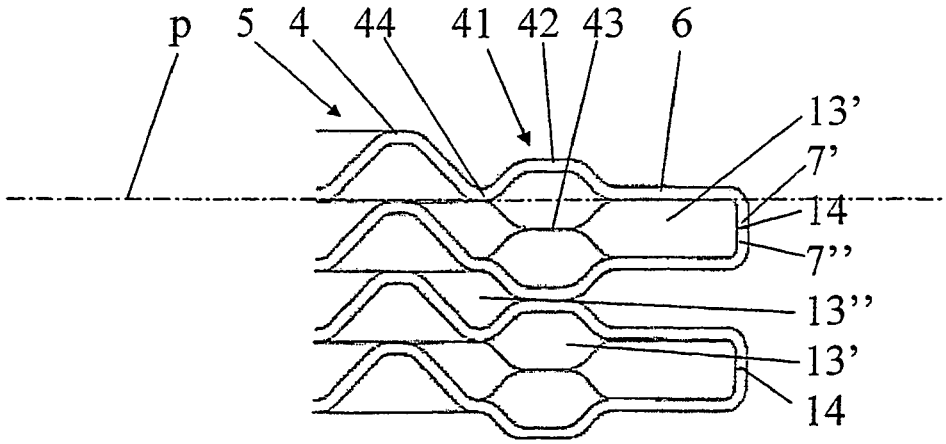
FIG. 7 discloses a sectional view along the line VII—VII in FIG. 4.

The ridges 42 and the valleys 43 of the support area 41 are thus positioned in such a way that each valley 43 in the support area 41 of a plate 4 abuts a ridge 42 in the support area of a plate 4 lying therebelow, see FIGS. 6 and 7. In such a way support lines, or elongated support surfaces, will always be formed between all adjacent plates 4 in the plate package 3, which support lines extend in the directions of the ridges 42 and the valleys 43. Also the support area 41 has such a shape that the outer and inner contour of the support area 41 coincide for all plates 4 in the plate package 3.

Figure 8:
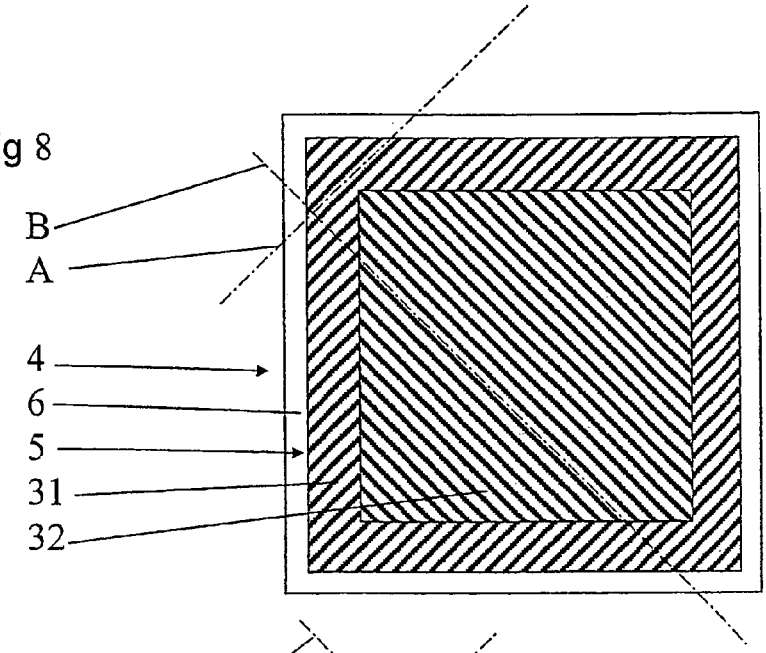
FIG. 8 discloses a plan view of a plate according to a second embodiment.

FIG. 8 discloses a plate 4 with a heat exchanging surface 5 which is divided in into two areas 31, 32 according to a second embodiment. The inner area 32 is shaped as a square that is positioned in such a way that the side edges of the outer contour of the inner area 32 extend in parallel to the most closely lying side edges of the outer contour of the outer area 31.

Figure 9:
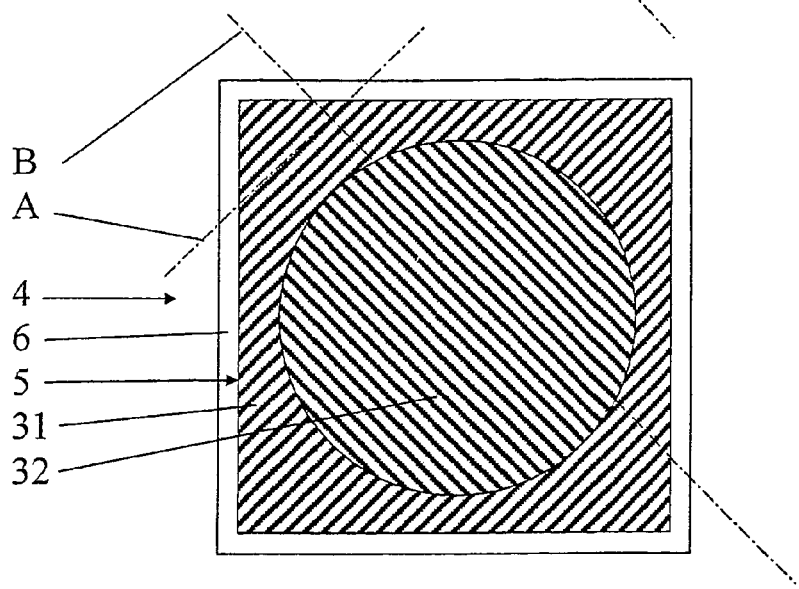
FIG. 9 discloses a plan view of a plate according to a third embodiment.

FIG. 9 discloses a plate 4 with a heat exchanging surface 5 that is divided into two areas 31, 32 according to a third embodiment. The inner area 32 is shaped as a circle that is positioned in such a way that the centre point of the circle coincides with the centre point of the outer area 31.

Figure 10:
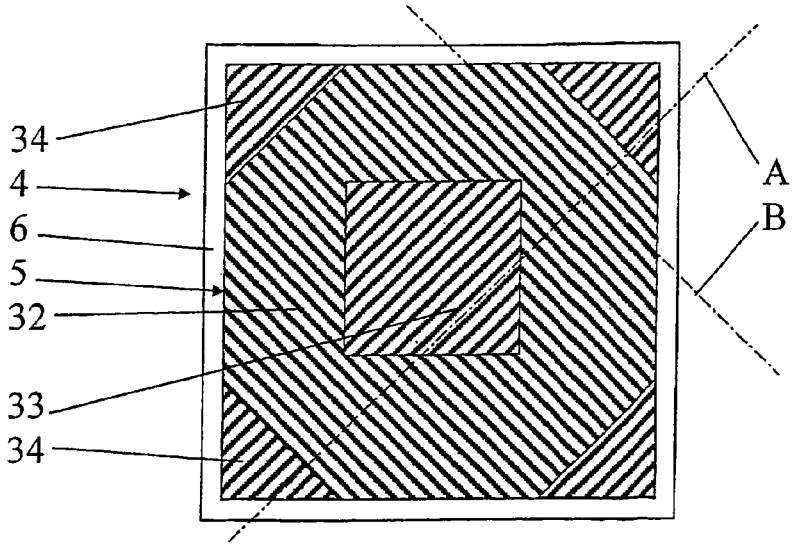
FIG. 10 discloses a plan view of a plate according to a fourth embodiment.

FIG. 10 discloses a plate 4 with a heat exchanging surface 5 which is divided into a plurality of areas according to a fourth embodiment. The plate 4 has two mains areas 31, 32, wherein one of the main areas 31 includes a central square area 33 and four triangular corner areas 34, one in each corner.

All plates according to FIGS. 8–10 are as the plate in FIG. 4 also shaped in such a way that each area 31, 32, 33, 34 has a respective outer and/or inner contour, which coincide with a respective imaginary stationary contour in the above-mentioned first rotary position of the plate 4 with regard to the rotary axis x, and after a rotation of 90° to the above-mentioned second rotary position of the plate 4 with regard to the rotary axis x. The total area of one of the areas 31, or the main area 31, is substantially equal to the total area of the other area 32, or the main area 32.

It is to be noted that the support area 41 is not indicated in FIGS. 8–10, but these embodiments may of course also include a support area 41 of the type described above.

The invention is not limited to the embodiments disclosed but may be varied and modified within the scope of the following claims.

It is to be noted that the invention also is applicable to plates that lack the disclosed support area 41.

What is claimed is:

1. A heat exchanger plate for a plate heat exchanger, having at least a first area with a corrugation of ridges and valleys, the plurality of which extends in a first direction, the plate having a central rotary axis (x) which extends in parallel with a normal line of the plate, and the plate including at least a second area with a corrugation of ridges and valleys, the plurality of which extends in a second direction, said first and second areas having a respective contour, coinciding with a respective imaginary stationary contour in a first rotary position of the plate with regard to said rotary axis (x) and after a rotation of 90° to a second rotary position of the plate with regard to the rotary axis (x), wherein the plate has an edge, which extends around the plate, and an edge area, which extends around the plate inside the edge, and is substantially square and has four side edges and four corners, wherein first two of said side edges are parallel and folded in a first direction along a respective folding line extending in said edge area in parallel with the side edge in question, wherein second two of said side edges are parallel and folded in a second direction along a respective folding line extending in said edge area in parallel with the side edge in question, and wherein the first direction is opposite to the second direction.

2. A plate according to claim 1, wherein the area of said first area is substantially equal to the area of said second area.

3. A plate according to claim 1, wherein the first direction is substantially perpendicular to the second direction.

4. A plate according to claim 1, wherein the plate includes a diagonal line, wherein the first direction is substantially parallel to the diagonal line.

5. A plate according to claim 1, wherein the plate has a contour that coincides with an imaginary stationary contour in said first rotary position and in said second rotary position.

6. A plate according to claim 4, wherein said diagonal line extends between two opposite ones of said corners.

7. A plate according to claim 1, wherein the plate, includes a support area, which extends around said first and second areas inside the edge area and includes a corrugation of ridges and valleys.

8. A plate according to claim 7, wherein the plate includes a marked border line between the support area and said first and second areas.

9. A plate according to claim 8, wherein in each corner the support area has such a ridge or valley, which extends in a direction that substantially coincides with a diagonal line between the corners.

10. A plate according to claim 8, wherein substantially each ridge and valley of the support area along a central part of the side edges extends in a direction that is substantially perpendicular to the side edge lying most closely to said ridge and valley.

11. A plate according to claim 10, wherein the direction of the ridges and the valleys of the support area changes successively from the diagonal direction in the corner to the perpendicular direction in the central part.

12. A plate according to claim 7, wherein the plate includes an extension plane (p), which extends in and in parallel to the edge area, wherein said valleys of the first and second areas are located at the extension plane (p) and said ridges of the first and second areas are located above the extension plane (p).

13. A plate according to claim 12, wherein said valleys of the support area are located below the extension plane (p) and said ridges of the support area are located above the extension plane (p).

14. A plate package for a plate heat exchanger, wherein the plate package includes a number of substantially square plates each having four corners and at least a first area with a corrugation of ridges and valleys, the plurality of which extends in a first direction, the plates having a central rotary axis (x) which extends in parallel with a normal line of the plates, and each plate including at least a second area with a corrugation of ridges and valleys, the plurality of which extends in a second direction, the first direction and the second direction forming an angle greater than zero and less than 180 degrees with respect to one another, said first and second areas having a respective contour, coinciding with a respective imaginary stationary contour in a first rotary position of the plates with regard to said rotary axis (x) and after a rotation of 90° to a second rotary position of the plates with regard to the rotary axis (x), said plates being arranged on each other, wherein the plates in the plate package are arranged in such a way that every second plate is rotated 90° around said rotary axis (x) and in such a way that interspaces are formed between adjacent plates, wherein said first and second areas have such a shape that the contour of the first areas coincides for all plates in the plate package and that the contour of the second areas coincides for all plates in the plate package and wherein the plates in the plate package are welded to each other.

15. A plate package according to claim 14 wherein the plates have an edge around the plate and have an edge area that extends around each plate inside its edges and have four side edges, a first two of said side edges being parallel and folded in a first direction along a respective folding line extending in said edge area in parallel with the side edge in question, a second two of said side edges being parallel and folded in a second direction along a respective folding line extending in said edge area in parallel with the side edge in question, wherein the first direction is opposite to the second direction, wherein the plates are arranged on each other in such a way that first side edges of a plate abut said second side edges of an adjacent plate and wherein the abutting side edges are connected to each other by means of a weld joint.

16. A plate package according to claim 15, wherein the plates include a support area which extends around said first and second areas inside the edge area and includes a corrugation of ridges and valleys.

17. A plate package according to claim 16, wherein the plates include a marked border line between the support area and said first and second areas.

18. A plate package according to claim 17, wherein in each corner the support area has such a ridge or valley, which extends in a direction that substantially coincides with a diagonal line between the corners.

19. A plate package according to claim 17, wherein substantially each ridge and valley of the support area along a central part of the side edges extends in a direction that is substantially perpendicular to the side edge lying most closely to said ridge and valley.

20. A plate package according to claim 19, wherein the direction of the ridges and the valleys of the support area changes successively from the diagonal direction in the corner to the perpendicular direction in the central part.

21. A plate package according to claim 16, wherein the plates include an extension plane (p), which extends in and in parallel to the edge area, wherein said valleys of the first and second areas are located at the extension plane (p) and said ridges of the first and second areas are located above the extension plane (p).

22. A plate package according to claim 21, wherein said valleys of the support area are located below the extension plane (p) and said ridges of the support area are located above the extension plane (p).

23. A plate package according to claim 14, wherein substantially all plates are substantially identical.

24. A plate package according to claim 14, wherein said interspaces include a number of first interspaces and a number of second interspaces, wherein the first interspaces are arranged to convey a first medium through the plate package and the second interspaces are arranged to convey a second medium through the plate package.

25. A plate heat exchanger, wherein the plate heat exchanger includes a plate package according to claim 14.

26. A plate package according to claim 14, wherein the area of said first area is substantially equal to the area of said second area.

27. A plate package according to claim 14, wherein the first direction is substantially perpendicular to the second direction.

28. A plate package according to claim 14, wherein the plates include a diagonal line and wherein the first direction is substantially parallel to the diagonal line.

29. A plate package according to claim 14, wherein the plates have a contour that coincides with an imaginary stationary contour in said first rotary position and in said second rotary position.

30. A plate package according to claim 28, wherein the diagonal line extends between two opposite corners of the plates.

* * * * *